United States Patent [19]

Taguchi

[11] 4,282,405

[45] Aug. 4, 1981

[54] SPEECH ANALYZER COMPRISING CIRCUITS FOR CALCULATING AUTOCORRELATION COEFFICIENTS FORWARDLY AND BACKWARDLY

[75] Inventor: Tetsu Taguchi, Tokyo, Japan

[73] Assignee: Nippon Electric Co., Ltd., Tokyo, Japan

[21] Appl. No.: 97,283

[22] Filed: Nov. 26, 1979

[30] Foreign Application Priority Data

Nov. 24, 1978 [JP] Japan ..... 53-145084

[51] Int. Cl.[3] ..... G10L 1/00

[52] U.S. Cl. ..... 179/1 SC; 179/1 SA

[58] Field of Search ..... 179/1 SC, 1 SA, 1 SB, 179/1 SD; 364/728; 324/77 R, 77 G

[56] References Cited

U.S. PATENT DOCUMENTS

| | | | |
|---|---|---|---|
| 4,015,088 | 3/1977 | Dubnowski et al. | 179/1 SC |
| 4,074,069 | 2/1978 | Tokura et al. | 179/1 SC |
| 4,081,605 | 3/1978 | Kitawaki et al. | 179/1 SC |
| 4,161,625 | 7/1979 | Katterfeldt et al. | 179/1 SC |

*Primary Examiner*—Mark E. Nusbaum
*Assistant Examiner*—E. S. Kemeny
*Attorney, Agent, or Firm*—Sughrue, Rothwell, Mion, Zinn and Macpeak

[57] ABSTRACT

A speech analyzer with improved pitch period extraction and improved accuracy of voiced/unvoiced decision comprises circuits for calculating autocorrelation coefficients forwardly and backwardly with respect to time. Reference members for the forward and the backward calculation are those successively prescribed ones of windowed samples of a signal representative of speech sound which are placed in each window period farther from a trailing and a leading end thereof, respectively. Members to be joined to the respective reference members for forward and backward calculation of each autocorrelation coefficient are displaced therefrom by a joining interval farther from the leading and the trailing ends, respectively. The joining interval is varied between a shortest and a longest pitch period of the speech sound stepwise by a spacing between two successive windowed samples. One of the joining intervals for which the greatest of the autocorrelation coefficients is calculated during each window period gives a better pitch period for that period than ever obtained. The circuits may comprise a circuit for calculating a rate of increase of an average power of the speech sound in each window period and an autocorrelator for carrying out the forward and the backward calculation when the rate is less and greater than a preselected value, respectively. Alternatively, the circuits may comprise two autocorrelators, one for the forward calculation and the other for the backward calculation.

4 Claims, 5 Drawing Figures

SPEECH ANALYZER COMPRISING CIRCUITS FOR CALCULATING AUTOCORRELATION COEFFICIENTS FORWARDLY AND BACKWARDLY

BACKGROUND OF THE INVENTION

This invention relates to a speech analyzer, which is useful, among others, in speech communication.

Band-compressed encoding of voice or speech sound signals has been increasingly demanded as a result of recent progress in multiplex communication of speech sound signals and in composite multiplex communication of speech sound and facsimile and/or telex signals through a telephone network. For this purpose, speech analyzers and synthesizers are useful.

As described in an article contributed by B. S. Atal and Suzanne L. Hanauer to "The Journal of the Acoustical Society of America," Vol. 50, No. 2 (Part 2), 1971, pages 637–655, under the title of "Speech Analysis and Synthesis by Linear Prediction of the Speech Wave," it is possible to regard speed sound as a radiation output of a vocal tract that is excited by a sound source, such as the vocal cords set into vibration. The speech sound is represented in terms of two groups of characteristic parameters, one for information related to the exciting sound source and the other for the transfer function of the vocal tract. The transfer function, in turn, is expressed as spectral distribution information of the speech sound.

By the use of a speech analyzer, the sound source information and the spectral distribution information are extracted from an input speech sound signal and then encoded either into an encoded or a quantized signal for transmission. A speech synthesizer comprises a digital filter having adjustable coefficients. After the encoded or quantized signal is received and decoded, the resulting spectral distribution information is used to adjust the digital filter coefficients. The resulting sound source information is used to excite the coefficient-adjusted digital filter, which now produces an output signal representative of the speech sound.

As the spectral distribution information, it is usually possible to use spectral envelope information that represents a macroscopic distribution of the spectrum of the speech sound waveform and thus reflects the resonance characteristics of the vocal tract. It is also possible to use, as the sound source information, parameters that indicate classification into or distinction between a voiced sound produced by the vibration of the vocal cords and a voiceless or unvoiced sound resulting from a stream of air flowing through the vocal tract (a fricative or an explosive), an average power or intensity of the speech sound during a short interval of time, such as an interval of the order of 20 to 30 milliseconds, and a pitch period for the voiced sound. The sound source information is band-compressed by replacing a voiced and an unvoiced sound with an impulse response of a waveform and a pitch period analogous to those of the voiced sound and with white noise, respectively.

On analyzing speech sound, it is possible to deem the parameters to be stationary during the short interval mentioned above. This is because variations in the spectral distribution or envelope information and the sound source information are the results of motion of the articulating organs, such as the tongue and the lips, and are generally slow. It is therefore sufficient in general that the parameters be extracted from the speech sound signal in each frame period of the above-exemplified short interval. Such parameters serve well for the synthesis or production of the speech sound.

It is to be pointed out in connection with the above that the parameters indicative, among others, of the pitch period and the distinction between voiced and unvoiced sounds are very important for the speech sound analysis and synthesis. This is because the results of analysis for deriving such information have a material effect on the quality of the synthesized speech sound. For example, an error in the measurement of the pitch period seriously affects the tone of the synthesized sound. An error in the distinction between voiced and unvoiced sounds renders the synthesized sound husky and crunching or thundering. Any of such errors thus harms not only the naturalness but also the clarity of the synthesized sound.

On measuring the pitch period, it is usual to derive at first a series or sequence of autocorrelation coefficients from the speech sound to be analyzed. As will be described in detail later with reference to one of several figures of the accompanying drawing, the series consists of autocorrelation coefficients of a plurality of orders, namely, for various delays or joining intervals. By comparing the autocorrelation coefficients with one another, the pitch period is decided to be one of the delays that gives a maximum or greatest one of the autocorrelation coefficients.

As described in an article that Bishnu S. Atal and Lawrence R. Rabiner contributed to "IEEE Transactions on Acoustics, Speech, and Signal Processing," Vol. ASSP-24, No. 3 (June 1976), pages 201–212, under the title of "A Pattern Recognition Approach to Voiced-Unvoiced-Silence Classification with Applications to Speech Recognition," it is possible to use various criterion or decision parameters for the classification or distinction that have different values according as the speech sounds are voiced and unvoiced. Typical decision parameters are the average power, the rate of zero crossings, and the maximum autocorrelation coefficient indicative of the delay corresponding to the pitch period. Amongst such parameters, the maximum autocorrelation coefficient is useful and important.

The pitch period extracted from the autocorrelation coefficients is stable and precise at a stationary part of the speech sound at which the speech sound waveform is periodic during a considerably long interval of time as in a stationarily voiced part of the speech sound. The waveform, however, has only a poor periodicity at that part of transit of the speech sound at which a voiced and an unvoiced sound merge into each other as when a voiced sound transits into an unvoiced one or when a voiced sound builds up from an unvoiced one. It is difficult to extract a correct path period from such a transient part because the waveform is subject to effects of ambient noise and the formants. Classification into voiced and unvoiced sounds is also difficult at the transient part.

More particularly, the maximum autocorrelation coefficient has as great a value as from about 0.75 to 0.99 at a stationary part of the speech sound. On the other hand, the maximum value of autocorrelation coefficients resulting from the ambient noise and/or the formants is only about 0.5. It is readily possible to distinguish between such two maximum autocorrelation coefficients. The maximum autocorrelation coefficient for the speech sound, however, decreases to about 0.5 at a transient part. It is next to impossible to distinguish the latter maximum autocorrelation coefficient from the maximum autocorrelation coefficient resulting either from the ambient noise of the formants. Distinction between a voiced and an unvoiced sound becomes ambiguous if based on such maximum value.

SUMMARY OF THE INVENTION

It is therefore a general object of the present invention to provide a speech analyzer capable of analyzing speech sound with the pitch period thereof correctly extracted from the speech sound even at a transient part thereof.

It is a specific object of this invention to provide a speech analyzer of the type described, which is capable of correctly distinguishing between a voiced and an unvoiced part of the speech sound.

A speech analyzer to which this invention is applicable is for analyzing an input speech sound signal representative of speech sound of an input speech sound waveform into a plurality of signals of a first group representative of a preselected one of spectral distribution information ($K_1 \ldots K_p$) and spectral envelope information of the speech sound waveform and at least two signals of a second group representative of sound source information of the speech sound. The speech sound has a pitch period of a value variable between a shortest and a longest pitch period. The speech analyzer comprises two conventional means, namely, window processing means and first means which, for example may include an autocorrelator, or K-parameter meter and an amplitude meter. The window processing means is for processing the input speech sound signal into a sequence of a predetermined number of windowed samples (e.g., $X_0, X_1, \ldots X_{239}$), occurring over a time period defined as the predetermined window period (e.g., 30 milliseconds).

The time between samples defines a sample interval which, for example, can be 125 microseconds. The windowed samples are representative of the speech sound in each window period and equally distributed with respect to time between the leading and trailing end of the window period. The first means is connected to the window processing means and is for processing the windowed sample sequence into the first-group signals ($K_1, K_2, \ldots K_p$) and a first (A) of the second-group signals. The first signal is representative of amplitude information of the speech sound in the respective window periods.

According to an aspect of this invention, the speech analyzer comprises known average power calculating means operatively coupled to the first means for calculating with reference to the first signal an average power (P) of the speech sound during each window period, and increasing rate calculating means connected to the average power calculating means for calculating the rate of increase of the average power to produce a control signal ($S_c$) having a first value when the rate of increase is greater than a preselected value and a second value when the rate of increase is less than a preselected value. The speech analyzer further comprises a second means connected to the window processing means and the increasing rate calculating means for calculating a plurality of autocorrelation coefficients, R'(d), for a plurality of joining intervals, d, respectively. The joining intervals differ from one another by the equal spacing between two successive ones of the windowed samples and include a shortest and a longest joining interval which are decided in accordance with the shortest and the longest pitch periods, respectively.

The autocorrelation coefficients R'(d) are calculated by using reference members and joining members, wherein reference members are a first reference group of windowed samples (e.g., $X_0 \ldots X_{119}$) and wherein joining members are an equal group of windowed samples separated from said reference members by the joining interval. For example if the reference members are $X_0 \ldots X_{119}$, for a joining interval of $d=20$, the joining members would be $X_{20} \ldots X_{139}$. The portion of the total windowed samples which constitutes the reference members is designated the reference fraction of the window period.

The autocorrelation coefficients are either calculated forward or backward with respect to time depending on the value of the control signal. When calculated forward with respect to time the reference members are near the front end, time wise, of the window (e.g., $X_0 \ldots X_{119}$) and for each successive calculation the joining members move farther away from the front end. For example if one calculation uses the set of joining members $X_{20} \ldots X_{139}$, the next calculation uses the set of joining members $X_{21} \ldots X_{140}$. When calculated backward with respect to time the reference members are near the back end, time wise, of the window, and for each successive calculation the joining members move farther away from the back end. The speech analyser according to the aspect of this invention being described further comprises third means, e.g., a pitch picker connected to the second ($T_p$) means for producing a second of the second-group signals by finding a greatest value of the autocorrelation coefficients R'(d) for each window period and making the second signal represent those joining intervals as the pitch periods of the speech sound in the respective window periods for which the autocorrelation coefficients having the greatest values are calculated for the respective window periods.

In a second embodiment of the invention the means for generating the control signal $S_c$ can be dispensed with and instead of the autocorrelation coefficients R'(d) are calculated both forwardly and backwardly, time wise, for each window period. Additional means are provided for selecting the maximum R'(d) from all those calculated and using the corresponding joining interval $T_p$ as the pitch period for the window interval.

DESCRIPTION OF THE PREFERRED EMBODIMENTS

Figure 1:
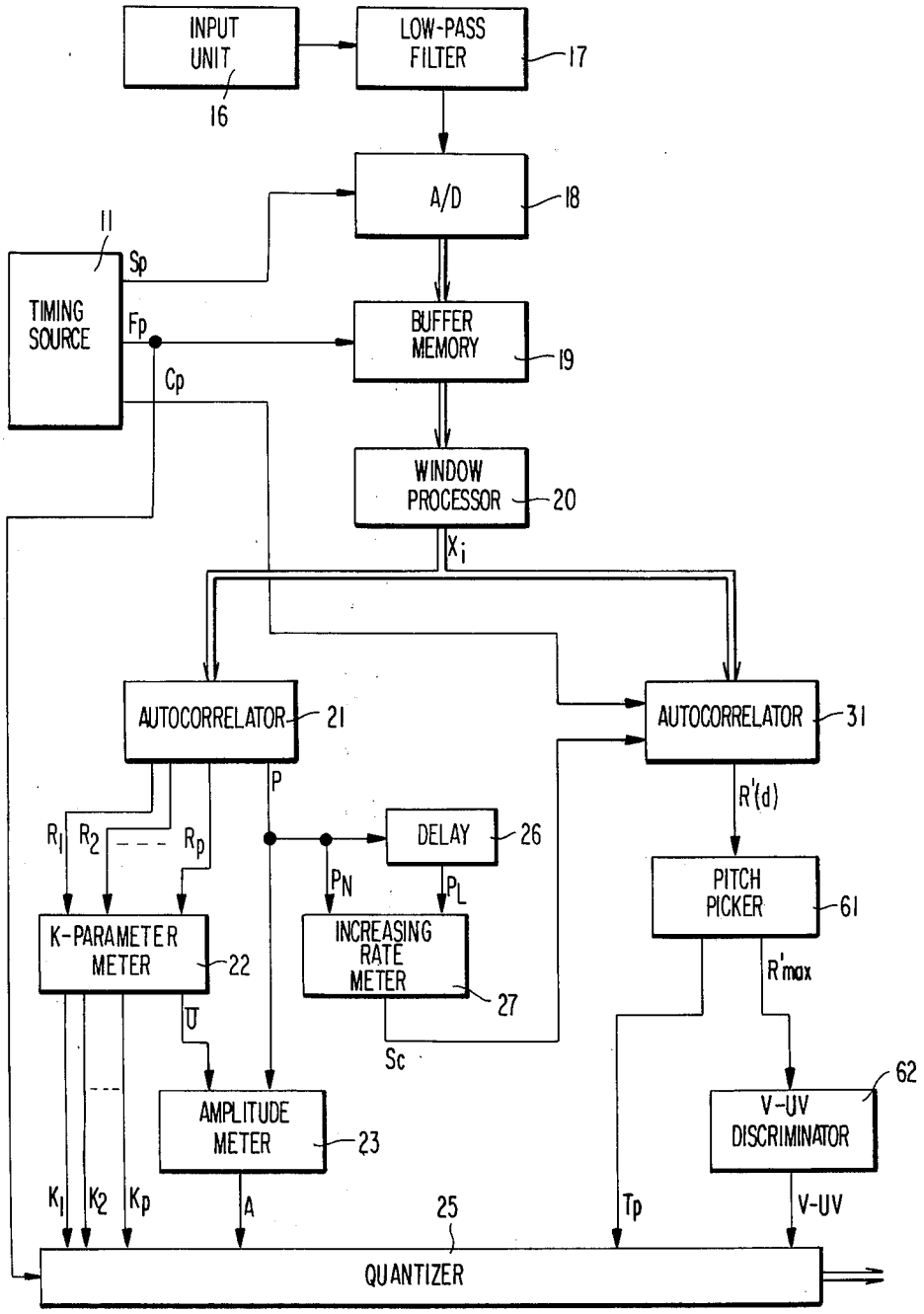
FIG. 1 is a block diagram of a speech analyzer according to a first embodiment of the instant invention.

Referring to FIG. 1, a speech analyzer according to a first embodiment of the present invention is for analyzing speech sound having an input speech sound waveform into a plurality of signals of a first group representative of spectral envelope information of the waveform and at least two signals of a second group representing sound source information of the speech sound. The speech sound has a pitch period of a value variable between a shortest and a longest pitch period. The speech analyzer comprises a timing source 11 having first through third output terminals. The first output terminal is for a sampling pulse train Sp for defining a sampling period or interval. The second output terminal is for a framing pulse train Fp for specifying a frame period for the analysis. When the sampling pulse train Sp has a sampling frequency of 8 kHz, the sampling interval is 125 microseconds. If the framing pulse train Fp has a framing frequency of 50 Hz, the frame period is 20 milliseconds and is equal to one hundred and sixty sampling intervals. The third output terminal is for a clock pulse train Cp for use in calculating autocorrelation coefficients according to this invention and may have a clock frequency of, for example, 4 MHz. It is to be noted here that a signal and the quantity represented thereby will often be designated by a common signal in the following.

The speech analyzer shown in FIG. 1 further comprises those known parts which are to be described merely for completeness of disclosure. A combination of these known parts is an embodiment of the principles described by John Makhoul in an article he contributed to "Proceedings of the IEEE," Vol. 63, No. 4 (April 1975), pages 561–580, under the title of "Linear Prediction: A Tutorial Review."

Among the known parts, an input unit 16 is for transforming the speech sound into an input speech sound signal. A low-pass filter 17 is for producing a filter output signal wherein those components of the speech sound signal are rejected which are higher than a predetermined cutoff frequency, such as 3.4 kHz. An analog-to-digital converter 18 is responsive to the sampling pulse train Sp for sampling the filter output signal into samples and converting the samples to a time sequence of digital codes of, for example, twelve bits per sample. A buffer memory 19 is responsive to the framing pulse train Fp for temporarily memorizing a first preselected length, such as the frame period, of the digital code sequence and for producing a buffer output signal consisting of successive frames of the digital code sequence, each frame followed by a next succeeding frame.

A window processor 20 is another of the known parts and is for carrying out a predetermined window processing operation on the buffer output signal. More particularly, the processor 20 memorizes at first a second preselect length, called a window period for the analysis, of the buffer output signal. The window period may, for example, be 30 milliseconds. A buffer output signal segment memorized in the processor 20 therefore consists of a present frame of the buffer output signal and that portion of a last or next previous window frame of the buffer output signal which is contiguous to the present frame. The processor 20 subsequently multiplies the memorized signal segment by a window function, such as a Hamming window function described in the Makhoul article. The buffer output signal is thus processed into a windowed signal. The processor 20 now memorizes that segment of the windowed signal which consists of a finite sequence of a predetermined number N of windowed samples $X_i$ ($i=0, 1, \ldots, N-1$). The predetermined number N of the samples $X_i$ in each window period amounts to two hundred and forty for the numerical example being illustrated.

Responsive to the windowed samples $X_i$ read out of the window processor 20, a first autocorrelator 21, still another of the known parts, produces a preselected number p of coefficient signals $R_1, R_2, \ldots$, and $R_p$ and a power signal P. The preselected number p may be ten. For this purpose, a first autocorrelation coefficient sequence of first through p-th order autocorrelation coefficients R(1), R(2), . . . , and R(p) are calculated according to:

$$R(d) = \left( \sum_{i=0}^{N-1-d} X_i \cdot X_{i+d} \right) / P \tag{1}$$

where d represents orders of the autocorrelation coefficients R(d), namely, those delays or joining periods or intervals for reference members and sets of joint members for calculation of the autocorrelation coefficients R(d) which are varied from one sampling interval to p sampling intervals. As the denominator in Equation (1) and for the power signal P, an average power P is calculated for each window period by that part of the autocorrelator 21 which serves an average power calculator. The average power P is given by:

$$P = \sum_{i=0}^{N-1} X_i^2.$$

Supplied with the coefficient signals R(d), a linear predictor or K-parameter meter 22, yet another of the known parts, produces first through p-th parameter signals $K_1, K_2, \ldots$, and $K_p$ representative of spectral envelope information of the input speech sound waveform and a single parameter signal U representative of intensity of the speech sound. The spectral envelope information is derived from the autocorrelation coefficients R(d) as partial correlation coefficients or "K parameters" $K_1, K_2, \ldots$, and $K_p$ by recursively processing the autocorrelation coefficients R(d), as by the Durbin method discussed in the Makhoul article. The intensity is given by a normalized predictive residual power U calculated in the meantime.

In response to the power signal P and the single parameter signal U, an amplitude meter 23, a further one of the known parts, produces an amplitude signal A representative of an amplitude A given by $\sqrt{(U.P)}$ as amplitude information of the speech sound in each window period. The first through the p-th parameter signals $K_1$ to $K_p$ and the amplitude signal A are supplied to a quantizer 25 together with the framing pulse train Fp in the manner known in the art.

It is now understood that that part of the first autocorrelator 21 which calculates the first autocorrelation coefficient sequence for the respective window periods, the K-parameter meter 22, and the amplitude meter 23 serve as a circuit for processing the windowed sample sequence into the first-group signals and a first of the second-group signals. Among the second-group signals, the first signal serves to represent amplitude information of the speech sound in the respective window periods.

Further referring to FIG. 1, the speech analyzer comprises a delay circuit 26 in accordance with the embodiment being illustrated. The delay circuit 26 gives a delay of one window period to the power signal P. In contrast to the power signal P produced by the first autocorrelator 21 and now called an undelayed power signal $P_N$ representative of the average power P of the speech sound in a present window period, namely, a present average power $P_N$, a delayed power signal $P_L$ produced by the delay circuit 26 represents a previous average power $P_L$ of the speech sound in a last or next previous window period. The undelayed and the delayed power signals $P_N$ and $P_L$ are supplied to a power ratio or increasing rate calculator or meter 27 for producing a control signal Sc that has a value decided in a predetermined manner according to the rate of increase of the average power P successively calculated by the autocorrelator 21 for the present and the next previous window periods. More specifically, a ratio $P_N/P_L$ (or $P_L/P_N$) is calculated. The control signal Sc is given a first and a second value or a logic "1" and a logic "0" value when the ratio $P_N/P_L$ representative of the rate of increase is greater and less than a preselected value, respectively. It is possible to decide the preselected value empirically. The preselected value may be usually 0.05 dB/millisecond.

In order to correctly measure the pitch period, the speech analyzer further comprises a second autocorrelator 31 for calculating a second sequence of autocorrelation coefficients R'(d) by the use of the windowed samples $X_i$ read out of the window processor 20 under the control of the clock pulse train Cp and the control signal Sc. Orders or joining intervals d of the autocorrelation coefficients R'(d) are varied in consideration of the pitch periods of the speech sound in the respective window periods, namely, between a shortest and a longest joining intervals equal to those shortest and longest pitch periods, respectively, which are expressed in terms of the sampling intervals. When the rate of increase is less than the preselected value, the autocorrelation coefficients R'(d) are calculated forwardly with respect to time, namely, with lapse of time, according to:

$$R'(d) = \left(\sum_{i=0}^{M-1} X_i \cdot X_{i+d}\right) \div \sqrt{\left[\left(\sum_{i=0}^{M-1} X_i^2\right) \cdot \left(\sum_{i=0}^{M-1} X_{i+d}^2\right)\right]}, \quad (2)$$

where M represents a prescribed number common to reference members and members, called joint members, to be joined to the respective reference members by the respective joining intervals d. The prescribed number M may be equal to the predetermined number N minus the longest joining interval. The shortest and the longest pitch periods may be twenty-one sampling intervals (2.625 milliseconds) and one hundred and twenty sampling intervals (15.000 milliseconds), respectively. Under the circumstances, the prescribed number M may be equal to one hundred and twenty, a half of the predetermined number N. When the rate of increase is greater than the preselected value, the autocorrelation coefficients R'(d) are calculated backwardly as regards time by:

$$R'(d) = \left(\sum_{i=0}^{M-1} X_{N-1-i} \cdot X_{N-1-i-d}\right) \div \sqrt{\left[\left(\sum_{i=0}^{M-1} X_{N-1-i}^2\right) \cdot \left(\sum_{i=0}^{M-1} X_{N-1-i-d}^2\right)\right]}. \quad (3)$$

In order to describe calculation of the autocorrelation coefficients R'(d) of the second sequence in plain words, a leading and a trailing end of each window period will be referred to. First through two hundred and fortieth windowed samples $X_0$ to $X_{239}$ are equally spaced between the leading and the trailing ends. The first and the two hundred and fortieth windowed samples $X_0$ and $X_{239}$ are placed next to the leading and the trailing ends, respectively. The reference members for calculation of the autocorrelation coefficients R'(d) forwardly according to Equation (2) and backwardly by Equation (3) are those successively prescribed samples $X_0$ through $X_{M-1}$ and $X_{239}$ through $X_{239-M+1}$ of the windowed samples $X_0$ through $X_{239}$ which are placed in each window period farther from the trailing and the leading ends, respectively. The joint members of a set to be joined to the respective reference members $X_0$ through $X_{M-1}$ and $X_{239}$ through $X_{239-M+1}$ for forward and backward calculation of each autocorrelation coefficient, such as R'(21) or R'(120), are displaced therefrom by a joining interval, such as twenty-one or one hundred and twenty sampling intervals, forwardly farther from the leading end and backwardly farther from the trailing end, respectively. The joining interval is varied between a shortest and a longest joining interval stepwise by one sampling interval. When the pitch period is variable between twenty-one and one hundred and twenty sampling intervals, one hundred autocorrelation coefficients R'(d) of orders twenty-one through one hundred and twenty are calculated either forwardly or backwardly during each window period. Description of a plurality of sets of such joint members for the autocorrelation coefficients R'(d) of the respective orders is facilitated when a reference fraction of each window period is considered for the reference members and when a plurality of joint fractions of each window period are referred to for the respective sets.

Figure 2:
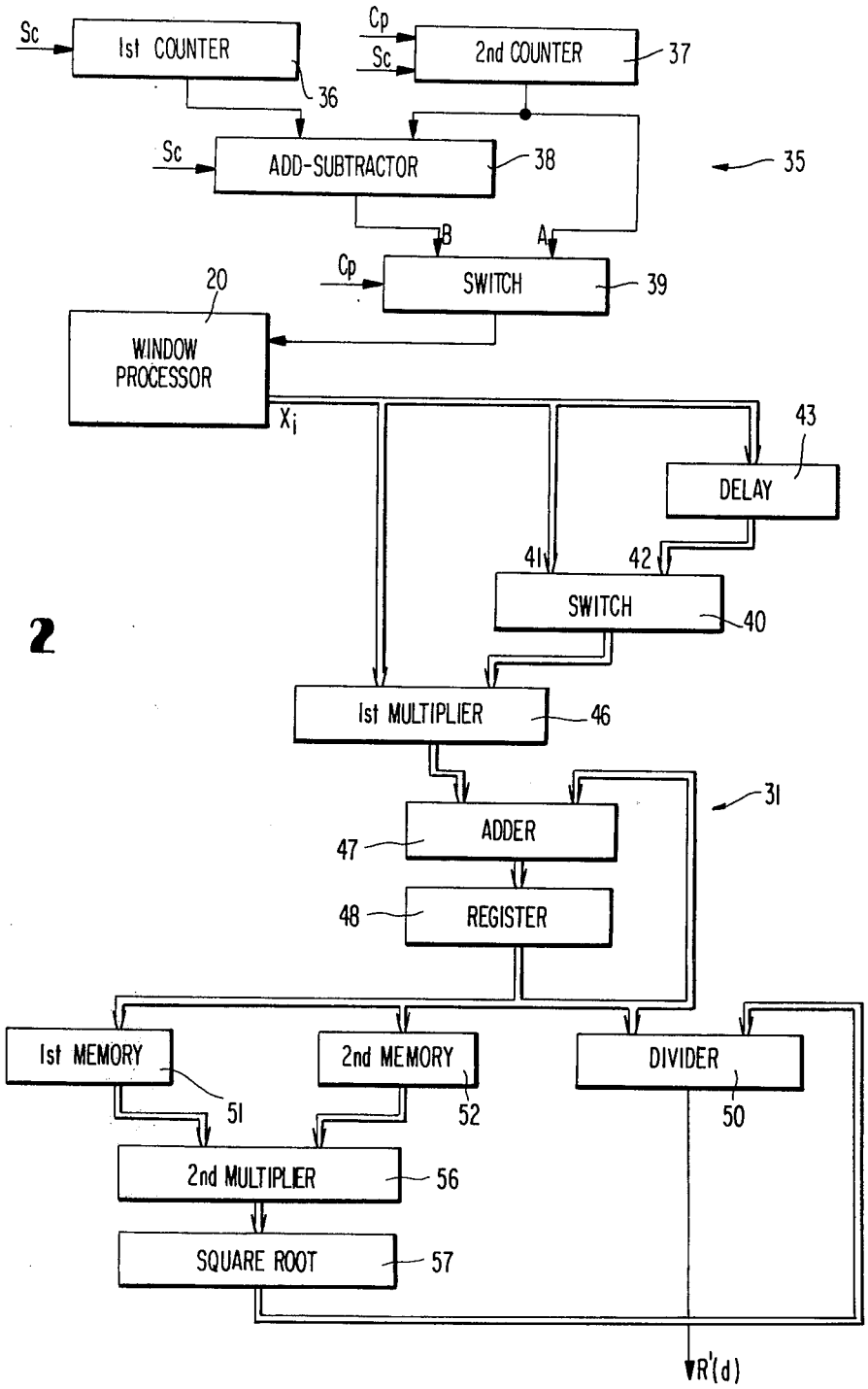
FIG. 2 is a block diagram of a window processor, an address signal generator, and an autocorrelator for use in the speech analyzer depicted in FIG. 1.

Referring temporarily to FIG. 2, let it be presumed that the window processor 20 comprises a plurality of memory cells (not shown) given addresses corresponding to a series of numbers ranging from "0" to the predetermined number N less one ("239") for memorizing the windowed samples $X_0$ to $X_{239}$ of each window period, respectively. The windowed samples $X_i$ memorized in the respective memory cells are renewed from those of each window period to the windowed samples of a next following window period at the framing frequency. The processor 20 is accompanied by an address signal generator 35, which may be deemed as a part of the second autocorrelator 31 depending on the circumstances. Responsive to the clock pulse train Cp and the control signal Sc, the address signal generator 35 produces an address signal indicative of numbers preselected from the series of numbers. Supplied with the address signal, the memory cells given the addresses corresponding to the preselected numbers produce the windowed samples memorized therein.

Merely for simplicity of description, the preselected numbers are varied in the following in an ascending and a descending order when the rate of increase of the average power P is less and greater than the preselected value, respectively, and accordingly when the control signal Sc has the second or logic "0" and the first or logic "1" values, respectively. For forward calculation of the autocorrelation coefficients R'(d) of the second sequence, the reference members exemplified above are read out of the memory cells with the address signal made to indicate "0" to "119" as the preselected numbers, respectively. The joint members for a first of the autocorrelation coefficients R'(d), namely, the autocorrelation coefficient of order twenty-one R'(21), are read out by making the address signal indicate "21" to "140" as the preselected numbers, respectively. The address signal indicates "22" to "141" for the joint members for a second of the autocorrelation coefficients R'(22). In this manner, the address signal is eventually made to indicate "120" to "239" for the joint members for a one hundredth of the autocorrelation coefficients R'(d) or the autocorrelation coefficient of order one hundred and twenty R'(120). For backward calculation, the reference members are read out by making the address signal indicate "239" to "120" as the preselected numbers, respectively. For the joint members for the first autocorrelation coefficient R'(21), "218" to "99" are indicated by the address signal. For the joint members for the one hundredth autocorrelation coefficient R'(120), "119" to "0" are indicated by the address signal.

The address signal generator 35 shown in FIG. 2 comprises first and second counters 36 and 37, an add-subtractor 38 for the counters 36 and 37, and a switch 39 having first and second contacts A and B for connecting the memory cells of the window processor 20 selectively to the second counter 37 and the add-subtractor 38, respectively. The first counter 36 is for holding a first count that is varied to serially represent the joining intervals "21" to "120" during each frame period. The first count represents each joining interval during a predetermined interval of time that comprises first through third partial intervals. The second counter 37 is for holding a second count that is varied serially from a first number to a second number during each of the first through the third partial intervals. The second count represent each of the numbers between the first and the second numbers, inclusive, during a clock period that is defined by the clock pulse train Cp and is shorter than the frame period divided by a product equal to three times the prescribed number M times the number of the autocorrelation coefficients R'(d) to be calculated for each window period during each frame period. When the control signal Sc has the logic "0" value and consequently when the reference members are placed farther from the trailing end of each window period, the first and the second numbers are made to be equal to "0" and the prescribed number M less one ("119"), respectively. When the control signal Sc is given the logic "1" value, the first and the second numbers are rendered equal to the predetermined number N less one ("239") and the predetermined number N minus the prescribed number M ("120"), respectively. The add-subtractor 38 is for calculating a sum of the first and the second counts and a difference obtained by subtracting the first count from the second count when the control signal Sc is rendered logic "0" and "1," respectively. The switch 39 is switched to the first contact A during the first partial intervals in each frame period, to the second contact B during the second partial intervals, and repeatedly between the contacts A and B within each clock period during the third partial intervals.

The second autocorrelator 31 depicted in FIG. 2 comprises a switch 40 having a first contact 41 connected directly to the memory cells of the window processor 20 and a second contact 42 connected to the memory cells through a delay circuit 43 for giving each of the read-out windowed samples $X_i$ a delay equal to a half of the clock period. A first multiplier 46 has a first input connected to the memory cells and a second input connected to the switch 40. An adder 47 has a first input connected to the multiplier 46, a second input, and an output. A register 48 has an input connected to the output of the adder 47 and an output connected to the second input of the adder 47. The adder 47 and the register 48 serve in combination as an accumulator. The output of the adder 47 is connected also to a first input of a divider 50 and to first and second memories 51 and 52. A second multiplier 56 has inputs connected to the memories 51 and 52 and an output connected to a square root calculator 57 connected, in turn, to a second input of the divider 50.

Operation of the address signal generator 35 will be described in detail at first for a case in which the control signal Sc has the logic "0" value, by which value the add-subtractor 38 is controlled to carry out the addition. At the beginning of each frame period, an initial count of "0" is set in the second counter 37. During the first partial interval of a first predetermined interval, the counter 37 is connected to the memory cells of the window processor 20 through the first contact A of the switch 39. The count in the counter 37 is counted up one by one towards "119" by the clock pulse train Cp. Subsequently, the second partial interval begins with the counter 37 reset to "0" and with the add-subtractor 38 connected to the memory cells through the second contact B. In the meanwhile, another initial count of "21" is set in the first counter 36 and kept therein throughout the first predetermined interval. After the count in the second counter 37 is again counted up to "119," the third partial interval begins with the second counter 37 again reset to "0." The second counter 37 and the add-subtractor 38 are now alternatingly connected to the memory cells through the switch 39 under the control of the clock pulse train Cp, which preferably has a duty cycle of 50°/o so that build up of each clock pulse serves to count up the second counter 37 and enable the first contact A while build down enables the second contact B. In the meantime, the second counter 37 is counted up once again to "119." A second predetermined interval now begins with the first counter 36 counted up from "21" to "22" by one and with the second counter 37 reset to "0" once again. Like operation is carried out during each predetermined interval until the add-subtractor 38 eventually makes the address signal specify "239" at the end of the third partial interval of a one hundredth predetermined interval.

The second autocorrelator 31 operates as follows irrespective of the value of the control signal Sc during the above-described operation of the address signal generator 35. Throughout the first and the second partial intervals of each predetermined interval, the second input of the first multiplier 46 is connected to the memory cells of the window processor 20 through the first contact 41 of the switch 40. During the first partial interval, a first summation of squares of the reference members, namely, the windowed samples $X_0$ through $X_{119}$, is accumulated in the accumulator. The summation is transferred to the first memory 51 at the end of the first partial interval. During the second interval, a second summation of squares of the joint members, such as the windowed samples $X_{21}$ through $X_{140}$ or $X_{120}$ through $X_{239}$, is accumulated in the accumulator and then transferred to the second memory 52 at the end of the second partial interval. During the third partial interval, the second input of the multiplier 46 is connected to the memory cells through the second contact 42. The reference members $X_0$ through $X_{119}$ reach the multiplier 46 through the delay circuit 43 simultaneously with the joint members, such as $X_{21}$ to $X_{239}$. A third summation of products $X_i.X_{i+d}$ is therefore accumulated in the accumulator and then supplied to the first input of the divider 50 as a dividend at the end of the third partial interval. In the meantime, the contents of the memories 51 and 52 are multiplied by each other by the second multiplier 56. A product calculated by the second multiplier 56 is delivered to the square root calculator 57, which calculates the square root of the product, namely, a geometric mean of the first and the second summations, and supplies the same to the second input of the divider 50 as a divisor. It is now understood that Equation (2) is calculated successively for the joining intervals d of "21" to "120" in the course of lapse of the hundred predetermined intervals.

When the control signal Sc is given the logic "1" value, the add-subtractor 38 is controlled to carry out the subtraction. At the beginning of each frame period, another initial value of "120" is set in the second counter 37. Alternatively, still another initial count of "239" may be set in the second counter 37 with the second counter 37 controlled to count down. In other respects, operation of the second autocorrelator 31 and the address signal generator 35 for the backward calculation defined by Equation (3) is similar to that described hereinabove for the forward calculation.

Referring back to FIG. 1, a signal representative of the second autocorrelation coefficient sequence is supplied to a pitch picker 61 for finding a maximum or the greatest value $R'_{max}$ of the autocorrelation coefficients R'(d) calculated for each window period and that pertinent one of the joining intervals Tp for which the autocorrelation coefficient having the greatest value $R'_{max}$ is calculated. The pertinent joining interval Tp represents the pitch period of the speech sound in each window period. A signal representative of the pertinent delays Tp's for the respective window periods is supplied to the quantizer 25 as a second of the second-group signals. A signal representative of the greatest values $R'_{max}$'s for the respective window periods is supplied to a voiced-unvoiced discriminator 62 for producing a voiced-unvoiced signal V-UV indicative of the fact that the speech sound in the respective window periods is voiced and unvoiced according as the greatest values $R'_{max}$'s are nearly equal to unity and are not, respectively. The V-UV signal is supplied to the quantizer 25 as a third of the second-group signals. The quantizer 25 now produces a quantized signal in the manner known in the art, which signal is transmitted to a speech synthesizer (not shown).

In connection with the description thus far made with reference to FIG. 1, it is to be pointed out that that part of the input speech sound waveform which has a greater amplitude is empirically known to be more likely voiced (periodic) than a part having a smaller amplitude. On the other hand, it has now been confirmed that a transient part of the speech sound, namely, that part of the waveform at which a voiced and an unvoiced sound merge into each other, should be dealt with as a voiced part for a better result of speech sound analysis and synthesis. When the rate of increase of the average power P is greater, the greatest value $R'_{max}$ of the autocorrelation coefficients of the second sequence R'(d) calculated for a window period related to a transient part has a greater value if calculated backwardly according to Equaiton (3). Under the circumstances, the maximum autocorrelation coefficient makes it possible to extract a more precise pitch period.

Figure 3:
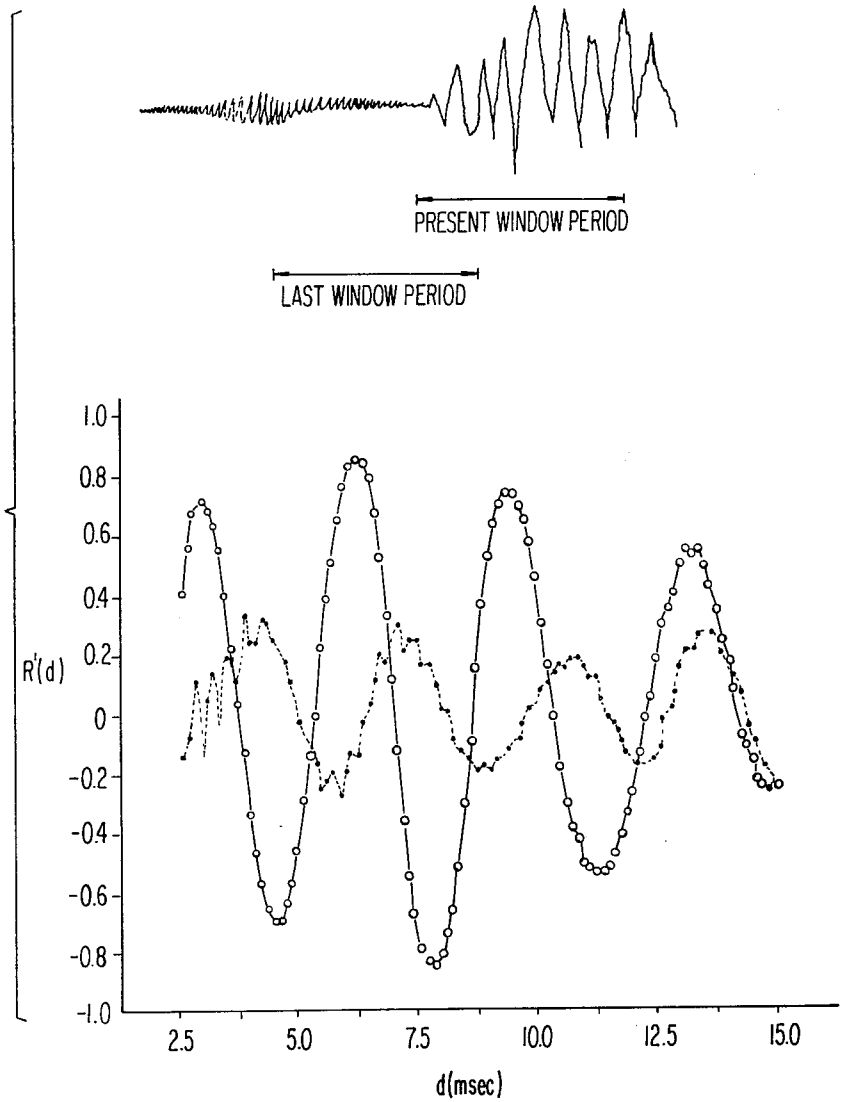
FIG. 3 shows graphs representative of typical results of experiment carried out for a word "he" by the use of a speech analyzer according to this invention.

Referring now to FIG. 3, a speech sound waveform for a word "he" is shown along the top line. It is surmised that a transient part between an unvoiced fricative similar to the sound [h] and a voiced vowel approximately represented by [i:] is spread over a last and a present window period. The pitch period of the speech sound in the present window period is about 6.25 milliseconds according to visual inspection. The rate of increase of the average power P is 0.1205 dB/millisecond when measured by a speech analyzer comprising an increasing rate meter, such as shown at 27 in FIG. 1, according to this invention with the window period set at 30 milliseconds. Autocorrelation coefficients R'(d) calculated forwardly and backwardly for various values of the joining intervals d are depicted in the bottom line along a dashed-line and a solid-line curve, respectively. According to the forward calculation, the greatest value $R'_{max}$ of the autocorrelation coefficients is 0.3177. This gives a pitch period of 3.88 milliseconds. The greatest value $R'_{max}$ is 0.8539 according to the backward calculation, which greatest value $R'_{max}$ gives a more correct pitch period of 6.25 milliseconds.

Figure 4:
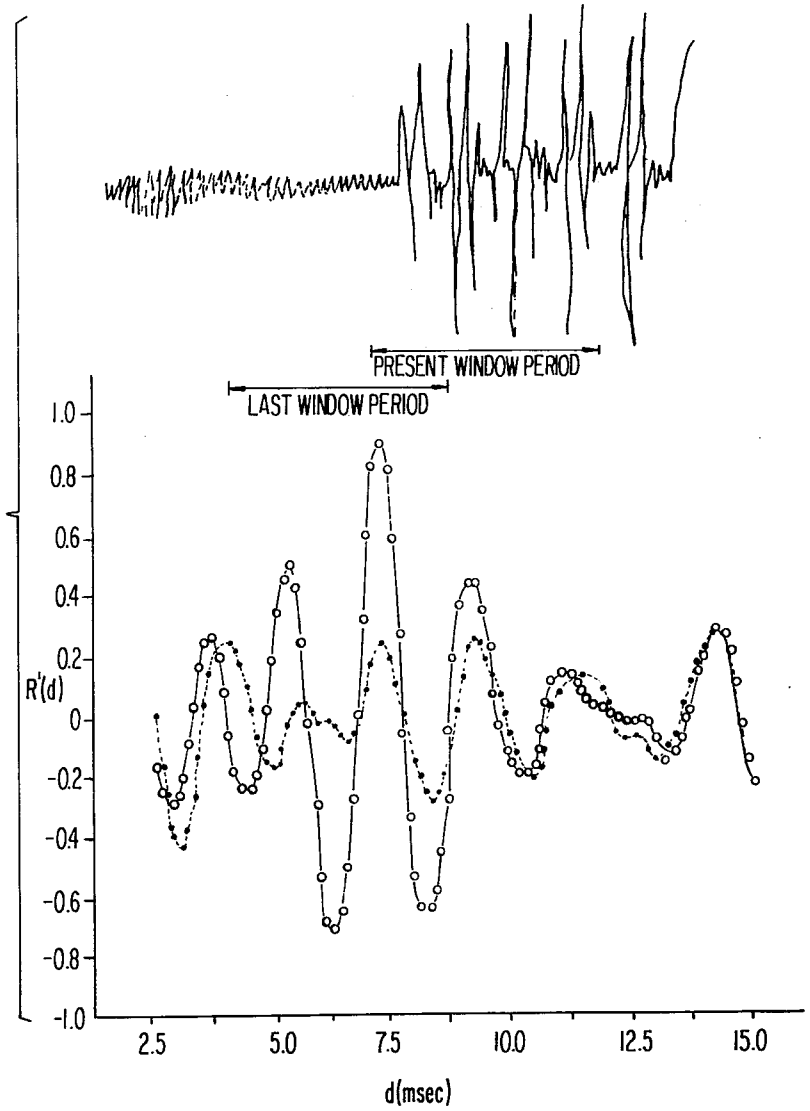
FIG. 4 shows graphs representing other typical results of experiment carried out for a word "took" by the use of a speech analyzer according to this invention.

Turning to FIG. 4, a speech sound waveform for a word "took" is illustrated along the top line. The pitch period of the speech sound in the present window period is about 7.25 milliseconds when visually measured. The rate of increase of the average power P is 0.393 dB/millisecond. Autocorrelation coefficients R'(d) calculated forwardly and backwardly are depicted in the bottom line again along a dashed-line and a solid-line curve, respectively. The greatest value $R'_{max}$ is 0.2758 according to the forward calculation. This gives a pitch period of 4.13 milliseconds. According to the backward calculation, the greatest value $R'_{max}$ is 0.9136. This results in a more precise pitch period of 7.25 milliseconds.

Figure 5:
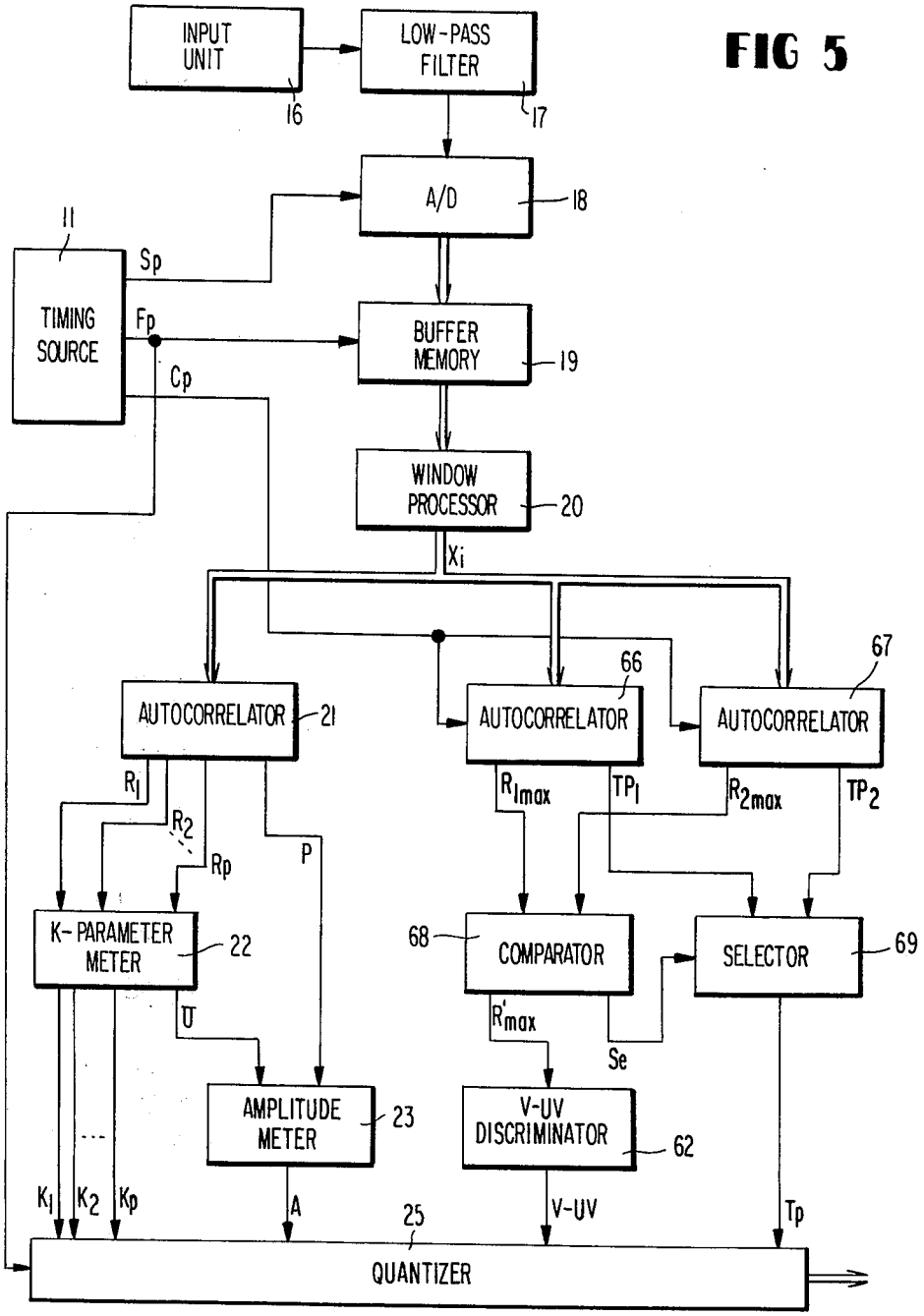
FIG. 5 is a block diagram of a speech analyzer according to a second embodiment of this invention.

Referring finally to FIG. 5, a speech analyzer according to a second embodiment of this invention comprises similar parts designated by like reference numerals and operable with similar signals denoted by like reference symbols. The speech analyzer being illustrated does not comprise the increasing rate meter 27 depicted in FIG. 1. Instead, two autocorrelators 66 and 67 always calculate forwardly a first series of autocorrelation coefficients $R_1(d)$ as a first part of the second autocorrelation coefficient sequence and backwardly a second series of autocorrelation coefficients $R_2(d)$ as a second part of the second sequence, respectively, for the series of window periods by the use of the windowed samples $X_i$ of the respective window periods. The autocorrelator 66 for the forward calculation comprises a first comparator (not separately shown) that is similar to the pitch picker 61 shown in FIG. 1 and is for comparing the autocorrelation coefficients $R_1(d)$ for each window period with one another to select a first maximum autocorrelation coefficient $R_{1.max}$ and to find that first pertinent one of the joining intervals $Tp_1$ for which the first maximum autocorrelation coefficient $R_{1.max}$ is calculated. Similarly, the autocorrelator 67 for the backward calculation comprises a second comparator (not separately depicted) for selecting a second maximum autocorrelation coefficient $R_{2.max}$ for each window period and finding a second pertinent joining interval $Tp_2$. A third comparator 68 compares the first and second maximum autocorrelation coefficients $R_{1.max}$ and $R_{2.max}$ with each other to select the greater of the two and to find a greatest value $R'_{max}$ for each window period. A signal representative of the greatest values $R'_{max}$'s for the respective window periods is supplied to the voiced-unvoiced discriminator 62. One of the first and second pertinent joining intervals $Tp_1$ and $Tp_2$ that corresponds to the greater of the first and the second autocorrelation coefficients $R'_{max}$ is selected by a selector 69 to which a selection signal Se is supplied from the comparator 68 according to the results of comparison of the first and the second maximum autocorrelation coefficient $R_{1.max}$ and $R_{2.max}$ for each window period. A signal representative of the successively selected ones of the first and the second pertinent joining intervals Tp's represents the pitch periods of the speech sound in the respective window periods and is supplied to the quantizer 25.

In FIG. 5, the two autocorrelators 66 and 67 may comprise individual address signal generators. Each of the individual address signal generators may be similar to that illustrated with reference to FIG. 2 except that each of the counters 36 and 37 is given an initial count that need not be varied depending on the control signal Sc. Alternatively, the autocorrelators 66 and 67 may share a single address signal generator similar to the generator 35 except that the clock pulse train Cp used therein should have a clock period that is shorter than the frame period divided by a product equal to six times the prescribed number M times the number of autocorrelation coefficients $R_1(d)$ or $R_2(d)$ to be calculated by each of the autocorrelators 66 and 67 for each window period.

While this invention has thus far been described in conjunction with a few embodiments thereof, it is now obvious to those skilled in the art that this invention can be put into practice in various other ways. For instance, the first-group signals may be made to represent the spectral distribution information rather than the spectral envelope information. Incidentally, a pitch period is calculated by a speech analyzer according to this invention in each frame period. A pitch period derived for each window period from the forwardly calculated autocorrelation coefficients of the second sequence may therefore represent, in an extreme case, the pitch period of the speech sound in that latter half of the next previous frame period which is included in the window period in question. This is nevertheless desirable for correct and precise extraction of the pitch period as will readily be understood from the discussion given above. The control signal Sc may have whichever of the first and the second values when the rate of increase of the average power P is equal to the preselected value.

What is claimed is:

1. A speech analyzer for analyzing an input speech sound signal representative of speech sound of an input speech sound waveform into a plurality of signals of a first group representative of a preselected one of spectral distribution information and spectral envelope information of said speech sound waveform and at least two signals of a second group representative of sound source information of said speech sound, said speech sound having a pitch period of a value variable between a shortest and a longest pitch period, said speech analyzer comprising:

window processing means for processing said input speech sound signal into a sequence of a predetermined number of windowed samples, said sequence lasting each of a series of predetermined window periods, said windowed samples being representative of the speech sound in said each window period and equally spaced with respect to time between a leading and a trailing end of said each window period;

first means connected to said window processing means for processing said windowed sample sequences into said first-group signals and a first of said second-group signals, said first signal being representative of amplitude information of the speech sound in the respective window periods;

average power calculating means operatively coupled to said first means for calculating with reference to said first signal an average power of the speech sound at least for said each window period and one of said window periods that next precedes said each window period in said series;

increasing rate calculating means connected to said average power calculating means for calculating for said each window period a rate of increase of the average power calculated for said each window period relative to the average power calculated for said next preceding window period to produce a control signal having a first and a second value when the rate of increase calculated for said each window period is greater and less than a preselected value, respectively;

second means connected to said window processing means and said increasing rate calculating means for calculating a plurality of autocorrelation coefficients for a plurality of joining intervals, respectively, by the use of reference members and joint members, said joining intervals differing from one another by the equal spacing between two successive ones of said windowed samples and including a shortest and a longest joining interval which are decided in accordance with said shortest and said longest pitch periods, respectively, said reference members being those prescribed ones of said windowed samples which are successively distributed throughout a reference fraction of said each window period, said reference fraction being placed farther with respect to time from the leading and the trailing ends of said each window period when said control signal has said first and said second values, respectively, said joint members being those sets of windowed samples, the windowed samples of each set being equal in number to said prescribed samples, which are successively distributed throughout a plurality of joint fractions of said each window period, respectively, said joint fractions being displaced in said each window period from said reference fraction by said joining intervals, respectively, farther from the trailing and the leading ends of said each window period when said control signal has said first and said second values, respectively; and third means connected to said second means for producing a second of said second-group signals by finding a greatest value of the autocorrelation coefficients calculated for the respective joining intervals for said each window period and making said second signal represent those joining intervals as the pitch periods of the speech sound in the respective window periods for which the autocorrelation coefficients having the greatest values are calculated for the respective window periods.

2. A speech analyzer for analyzing an input speech sound signal representative of speech sound of an input speech sound waveform into a plurality of signals of a first group representative of a preselected one of spectral distribution information and spectral envelope information of said speech sound waveform and at least two signals of a second group representative of sound source information of said speech sound, said speech sound having a pitch period of a value variable between a shortest and a longest pitch period, said speech analyzer comprising:

window processing means for processing said input speech sound signal into a sequence of a predetermined number of windowed samples, said sequence lasting each of a series of predetermined window periods, said windowed samples being representative of the speech sound in said each window period and equally spaced with respect to time between a leading and a trailing end of said each window period;

first means connected to said window processing means for processing said windowed sample sequences into said first-group signals and a first of said second-group signals, said first signal being representative of amplitude information of the speech sound in the respective window periods;

second means connected to said window processing means for simultaneously calculating two autocorrelation coefficient series, a first of said series consisting of a plurality of autocorrelation coefficients calculated for a plurality of joining intervals, respectively, by the use of reference members and joint members, said joining intervals differing from one another by the equal spacing between two successive ones of said windowed samples and including a shortest and a longest joining interval which are decided in accordance with said shortest and said longest pitch periods, respectively, said reference members being those prescribed ones of said windowed samples which are successively distributed throughout a first reference fraction of said each window period, said first reference fraction being placed farther with respect to time from the leading end of said each window period, said joint samples being those first sets of windowed samples, the windowed samples in each of said first sets being equal in number to said prescribed samples, which are successively distributed throughout a plurality of first joint fractions of said each window period, respectively, said first joint fractions being displaced in said each window period by said joining intervals, respectively, farther from the trailing end of said each window period, a second of said series consisting of a plurality of autocorrelation coefficients calculated for said joining intervals, respectively, by the use of reference members and joint members, the last-mentioned reference members being those prescribed ones of said windowed samples which are successively distributed throughout a second reference fraction of said each window period, said second reference fraction being placed farther with respect to time from the trailing end of said each window period, the last-mentioned joint members being those second sets of windowed samples, the windowed samples in each of said second sets being equal in number to the last-mentioned prescribed samples, which are successively distributed throughout a plurality of second joint fractions of said each window period, respectively, said second joint fractions being displaced in said each window period by said joining intervals, respectively, farther from the leading end of said each window period;

comparing means connected to said second means for comparing the autocorrelation coefficients of said first series calculated for the respective joining intervals in said each window period with one another to select a first maximum autocorrelation coefficient for said each window period, the autocorrelation coefficients of said second series calculated for the respective joining intervals in said each window period with one another to select a second maximum autocorrelation coefficient for said each window period, and said first and said second maximum autocorrelation coefficients with each other to select the greater of the two and to find for said each window period a greatest value that said greater autocorrelation coefficient has, said comparing means thereby finding such greatest values for the respective window periods; and third means connected to said comparing means for producing a second of said second-group signals with said second signal made to represent those joining intervals as the pitch periods of the speech sound in the respective window periods for which the autocorrelation coefficients having said greatest values are calculated for the respective window periods.

3. A speech analyzer as claimed in claims 1 or 2, further comprising fourth means connected to said third means for producing a third of said second-group signals by making said third signal represent said greatest values as information for classifying said speech sound into voiced and unvoiced speech sounds in the respective window periods.

4. A speech analyzer as claimed in claims 1 or 2, said window processing means having memory cells given addresses corresponding to a series of numbers ranging from zero to said predetermined number less one for memorizing the windowed samples successively distributed between the leading and the trailing ends of said each window period, respectively, to produce in response to an address signal indicative of numbers preselected from said series of numbers the windowed samples memorized in the memory cells given the addresses corresponding to said preselected numbers, respectively, the windowed samples memorized in said memory cells being renewed with a prescribed period that is shorter than said window period, wherein said second means comprises:

first counter means for holding a first count that represents numbers successively varied during said prescribed period between a number representative of said shortest joining interval and another number representative of said longest joining interval, said first count representing each number during a predetermined interval of time comprising a first, a second, and a third partial interval;

second counter means for holding a second count that represents numbers successively varied between a first and a second number during each of said first through said third partial intervals, said second count representing each number during a clock period equal at most to said prescribed period divided by a product equal to three times a prescribed number times that difference between said shortest and said longest joining intervals which is expressed in terms of said equal spacing, said prescribed number being equal to said predetermined number minus the number of windowed samples in said longest joining interval, said first and said second numbers being zero and said prescribed number less one, respectively, when said reference members are placed farther from the trailing end of said each window period, said first and said second numbers being said predetermined number less one and said predetermined number less said prescribed number, respectively, when said reference members are placed farther from the leading end of said each window period;

add-subtracting means for calculating a sum of said first and said second counts when said reference members are placed farther from the trailing end of said each window period and a difference of said second count less said first count when said reference members are placed farther from the leading end of said each window period;

switching means for successively rendering said preselected numbers equal to said second count during the first partial intervals in said each window period, to the calculated one of said sum and said difference during the second partial intervals in said each window period, and alternatingly to said second count and the calculated one of said sum and said difference within each clock period during the third partial intervals in said each window period;

first calculating means for calculating a first summation of squares of the windowed samples produced from the memory cells addressed by said address signal during the first partial interval in each predetermined interval, a second summation of squares of the windowed samples produced from the memory cells addressed by said address signal during the second partial interval of said each predetermined interval, and a third summation of products of the windowed sample pairs alternatingly produced from the memory cells addressed by said address signal during the third partial interval of said each predetermined interval;

second calculating means for calculating a geometric means of said first and said second summations at the end of the second partial interval of said each predetermined interval; and third calculating means for calculating the autocorrelation coefficients at the ends of the third partial intervals in said each window period by dividing the third summations calculated during the third partial intervals in said each window period by the respective ones of the geometric means calculated at the ends of the second partial intervals in said each window period.

* * * * *

UNITED STATES PATENT AND TRADEMARK OFFICE

CERTIFICATE OF CORRECTION

PATENT NO. : 4,282,405

DATED : August 4, 1981

INVENTOR(S) : Tetsu Taguchi

It is certified that error appears in the above—identified patent and that said Letters Patent is hereby corrected as shown below:

Column 1, line 22, delete "speed" and insert --speech--.

Column 2, line 3, delete "production" and insert --reproduction--.

Column 2, line 21, after "sound" insert --signal--.

Column 3, line 23, after "information" delete "($K_1$ ... $K_p$)".

line 24, after "information" insert "($K_1$ ... $K_p$)".

Column 4, line 31, after "second" delete "($T_p$)".

line 32, after "second" (first occurrence) insert --($T_p$)--.

Column 5, line 22, delete "signal" and insert --symbol--.

Signed and Sealed this

Twentieth Day of October 1981

[SEAL]

Attest:

GERALD J. MOSSINGHOFF

Attesting Officer

Commissioner of Patents and Trademarks